US005824979A

United States Patent [19]

Dam et al.

[11] Patent Number: 5,824,979

[45] Date of Patent: Oct. 20, 1998

[54] ACCELERATOR MODULE

[75] Inventors: Robert Dam, Aurora; Charles E. Marx, Norridge; Earl J. Genz, Des Plaines, all of Ill.

[73] Assignee: Illinois Tool Works Inc., Glenview, Ill.

[21] Appl. No.: 878,313

[22] Filed: Jun. 18, 1997

[51] Int. Cl.[6] ..... H01C 10/36; H01H 19/54

[52] U.S. Cl. ..... 200/61.88; 200/11 G; 338/172; 338/198

[58] Field of Search ..... 200/4, 5 R, 6 A, 200/11 R, 18, 61.45 R, 61.53, 61.88, 61.89, 61.91; 338/128, 172, 178, 179, 191, 198, 200, 215

[56] References Cited

U.S. PATENT DOCUMENTS

| | | | |
|---|---|---|---|
| 3,924,220 | 12/1975 | Matsui et al. | 338/198 X |
| 4,087,776 | 5/1978 | Donato | 338/198 |
| 4,123,740 | 10/1978 | Palmer et al. | 338/198 X |
| 4,355,293 | 10/1982 | Driscoll | 338/184 |
| 4,523,175 | 6/1985 | Sakurai | 338/134 |
| 4,604,506 | 8/1986 | Gebhardt | 200/61.89 |
| 4,654,626 | 3/1987 | Carsello | 338/172 |
| 4,827,241 | 5/1989 | Riser et al. | 338/172 |
| 4,983,946 | 1/1991 | Kotaki et al. | 338/200 |
| 5,023,414 | 6/1991 | Mihara et al. | 200/61.91 |
| 5,086,785 | 2/1992 | Gentile et al. | 338/210 X |
| 5,271,269 | 12/1993 | Rilling et al. | 338/98 X |
| 5,440,087 | 8/1995 | Cobb, III | 200/61.88 |
| 5,525,768 | 6/1996 | Cobb, III et al. | 200/61.88 |

*Primary Examiner*—J. R. Scott
*Attorney, Agent, or Firm*—Schwartz & Weinrieb

[57] ABSTRACT

An accelerator module comprises a printed circuit board having resistance elements mounted thereon, and an actuator pivotably mounted upon the printed circuit board and having a wiper member mounted upon a first end of the actuator. A rotary input shaft, connected to an accelerator pedal of an electric vehicle, has an input shaft arm fixedly mounted thereon, and the input shaft arm is pivotably connected to a second end of the actuator whereby the structural arrangement defines a mechanically advantaged linkage system whereby a predetermined pivotable movement of the rotary input shaft and its associated input shaft arm translates into an enhanced, enlarged, or magnified pivotable movement of the actuator and its associated wiper member for movement along the resistance elements of the printed circuit board.

21 Claims, 4 Drawing Sheets

ACCELERATOR MODULE

CROSS-REFERENCE TO RELATED PATENT APPLICATION

This patent application is related to U.S. patent application Ser. No. 08/603,041 filed on Feb. 16, 1996 and entitled METHOD AND APPARATUS FOR AN ELECTRICAL SWITCH AND VARIABLE RESISTANCE MODULE.

FIELD OF THE INVENTION

The present invention relates generally to electrical switches and variable electrical resistance mechanisms used in conjunction therewith, and more particularly to an electrical switch and variable electrical resistance mechanism which may be readily incorporated within an accelerator module utilized in connection with electric vehicles.

BACKGROUND OF THE INVENTION

Electrical switches and variable electrical resistance mechanisms are utilized in many different applications in order to, in effect, undergo and operatively sense or determine a positional change in response to movement of an operatively associated movable member, and furthermore, to provide or generate a corresponding electrical signal, indicative of such positional change, to an electrical controller. An exemplary use of such switches and variable electrical resistance mechanisms is in conjunction with an accelerator pedal of an electric vehicle whereupon depression of the accelerator pedal, the variable electrical resistance mechanism will generate an electrical signal which varies in proportion to the displacement or depression of the accelerator pedal which, of course, corresponds to the degree of acceleration desired by the vehicle operator.

The variable resistance mechanism, as is normally the case with a potentiometer or other similar variable resistance device, is mechanically linked to the movable member so as to sense or determine the displacement or movement of the movable member over a predetermined range of movement. More particularly, in the case of utilizing such a system in connection with an accelerator pedal of an electric vehicle, the aforenoted related patent application discloses a system wherein a potentiometer shaft is operatively connected to an arm or the like which extends from the accelerator pedal so as to be rotated in response to depression or displacement of the accelerator pedal, and a lever or actuator, carrying a wiper element for defining a wiping contact with constant and variable resistance elements disposed upon a printed circuit board of the electrical assembly, is provided upon the rotary shaft.

The aforenoted system, more specifically disclosed within the aforenoted related patent application, is illustrated in FIGS. 1 and 2 of the drawings of the present patent application, wherein such FIGS. 1 and 2 of the present patent application correspond to FIGS. 1 and 2 of the aforenoted related patent application drawings, however, the details and description of the illustrated and disclosed system of the aforenoted related patent application are only briefly described hereinbelow, and only the relevant component parts of the system have been designated by reference characters, as is necessary to the understanding of such a related system. More particularly, the system is generally indicated by the reference character 10 and comprises a switch 20 which is disposed within a housing 100, and a printed circuit board 300, carrying a constant resistance element 32 and a variable resistance element 34, which is also disposed within the housing 100. An actuator body member 220, carrying wiper elements 420 for wipingly engaging the constant resistance element 32 and the variable resistance element 34, is pivotably disposed within the housing 100 as a result of being fixedly mounted upon a rotatable shaft 60 by means of a sleeve portion 230. The sleeve portion 230 of the actuator body member 220 is axially or longitudinally fixed with respect to the shaft 60 by means of a collar 70 and a set screw 74 which extends through a threaded bore 72 of the collar 70 so as to engage the shaft 60. The shaft 60 is, of course, operatively connected to the movable member or accelerator pedal, not shown. A torsion spring 170 biases the actuator body member 220 toward the position illustrated in FIG. 1 such that the actuator body member 220 is normally engaged with the switch 20.

While the aforenoted system has in fact proven to be quite satisfactory from an operational point of view in that the same achieves its operational objectives in a reliable manner in order to properly control, for example, the acceleration mode requirements of the associated electric vehicle, it is noted that due to the fact that the actuator body member 220, upon which the wiper elements 420 are mounted, is mounted directly upon the shaft 60 to which the accelerator pedal, not shown, is connected through means of the sleeve portion 230, the angular or arcuate extent through which the actuator body member 220, and therefore the wiper elements 420 mounted thereon, may be moved is limited. In addition, due to the fact that the actuator body member 220 is, in effect, disposed or mounted upon the shaft 60, through means of its sleeve portion 230, in a substantially cantilevered manner, and that the wiper elements 420 are mounted upon the free or distal end portion of the cantilevered actuator body member 220, the positional tolerances or disposition of the wiper elements 420, with respect to the constant and variable resistance elements 32 and 34 of the printed circuit board 300, cannot always be predetermined or controlled in a manner which is as precise as desired or required. As a result, the pre-load or biasing forces of the wiper elements 420, with respect to or upon the constant and variable resistance elements 32 and 34 of the printed circuit board 300, are not necessarily always able to be predetermined or controlled as desired or required whereby, for example, excessive wear of the constant and variable resistance elements 32 and 34 of the printed circuit board 300 may result.

A need therefore exists in the art for a new and improved accelerator module for an electric vehicle which incorporates therein a variable resistance control mechanism or arrangement wherein an enhanced variable resistance control range is able to be achieved, and wherein tolerances of the various components of the mechanism can be tightly controlled such that a predetermined amount of pre-load pressure or biasing force is impressed upon the constant and variable resistance elements of the printed circuit board by means of the wiper mechanism or elements mounted upon the actuator so as not to cause excessive wear of the resistance elements of the printed circuit board.

OBJECTS OF THE INVENTION

Accordingly, it is an object of the present invention to provide a new and improved accelerator module for an electric vehicle.

Another object of the present invention is to provide a new and improved accelerator module for an electric vehicle which overcomes the various drawbacks and disadvantages characteristic of known electric vehicle accelerator modules.

A further object of the present invention is to provide a new and improved accelerator module for an electric vehicle wherein the arrangement of the components parts is able to achieve an enhanced range of movement for the wiper mechanism with respect to the resistance elements of the printed circuit board.

An additional object of the present invention is to provide a new and improved accelerator module for an electric vehicle wherein the arrangement of the components parts enables manufacture and assembly of the module with tightly controlled tolerance values such that a predetermined amount of pre-load pressure or biasing force is impressed upon the resistance elements of the printed circuit board by means of the wiper mechanism and the elements thereof whereby excessive wear of the resistance elements of the printed circuit board is effectively prevented.

SUMMARY OF THE INVENTION

The foregoing and other objectives are achieved in accordance with the teachings and principles of the present invention through the provision of an accelerator module wherein, as was the case of the module disclosed within the aforenoted related patent application, the wiper mechanism and the wiper elements thereof are mounted upon a pivotable actuator, however, in lieu of the actuator being pivotably mounted directly upon the accelerator pedal input shaft such that the wiper mechanism and the wiper elements thereof are located at positions remote from the pivot axis of the actuator, the actuator of the present invention is pivotably mounted, at a substantially central portion thereof, upon the printed circuit board. The wiper elements are mounted upon one end of the actuator while the opposite end of the actuator is mechanically linked to one end of an input shaft arm while the other end of the input shaft arm is fixedly connected to the pivotable input shaft.

By means of this structural interrelationship or arrangement defined between the input shaft, the input shaft arm, the actuator, and the wiper mechanism comprising the wiper elements, a mechanical advantage is provided for the actuator whereby as a result of a predetermined pivoted movement of input shaft and input shaft arm, the actuator, and the wiper elements mounted thereon, undergo an enhanced pivoted movement which is approximately three times the pivoted movement of the input shaft and input shaft arm. Consequently, an increased range of movement of the actuator, and the wiper elements mounted thereon, is achieved. In addition, since the wiper elements are disposed substantially closer to the pivot axis of the actuator, and the manufacturing tolerances of the components which serve to mount the actuator upon the printed circuit board can be easily or readily controlled, the pre-load pressure forces of the wiper elements, as impressed upon the resistance elements of the printed circuit board, can be controlled such that the resistance elements of the printed circuit board do not experience excessive wear.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 2:
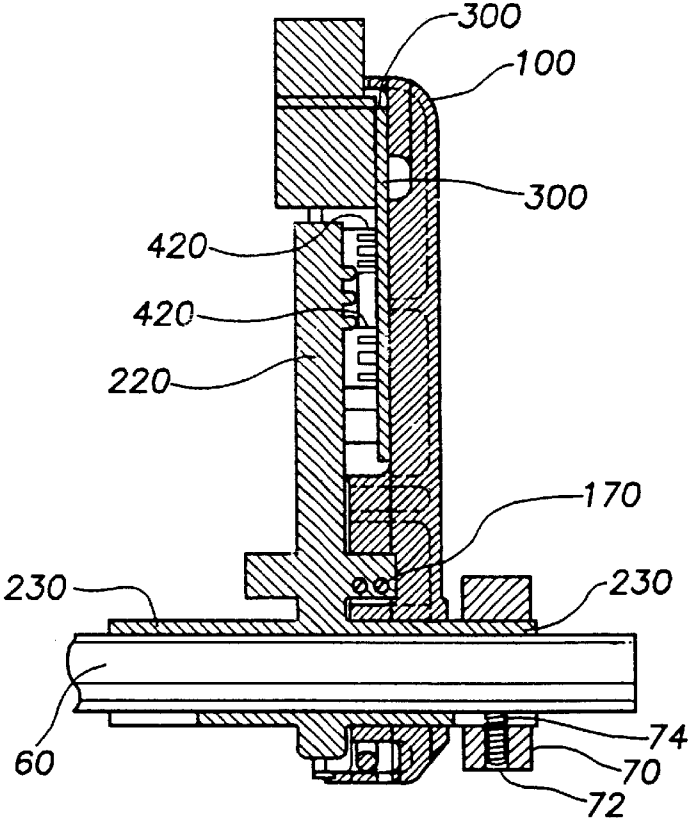
FIG. 2 is a cross-sectional view of the electrical switch and variable resistance module shown in FIG. 1 as taken along line 2—2 of FIG. 1.
Figure 1:
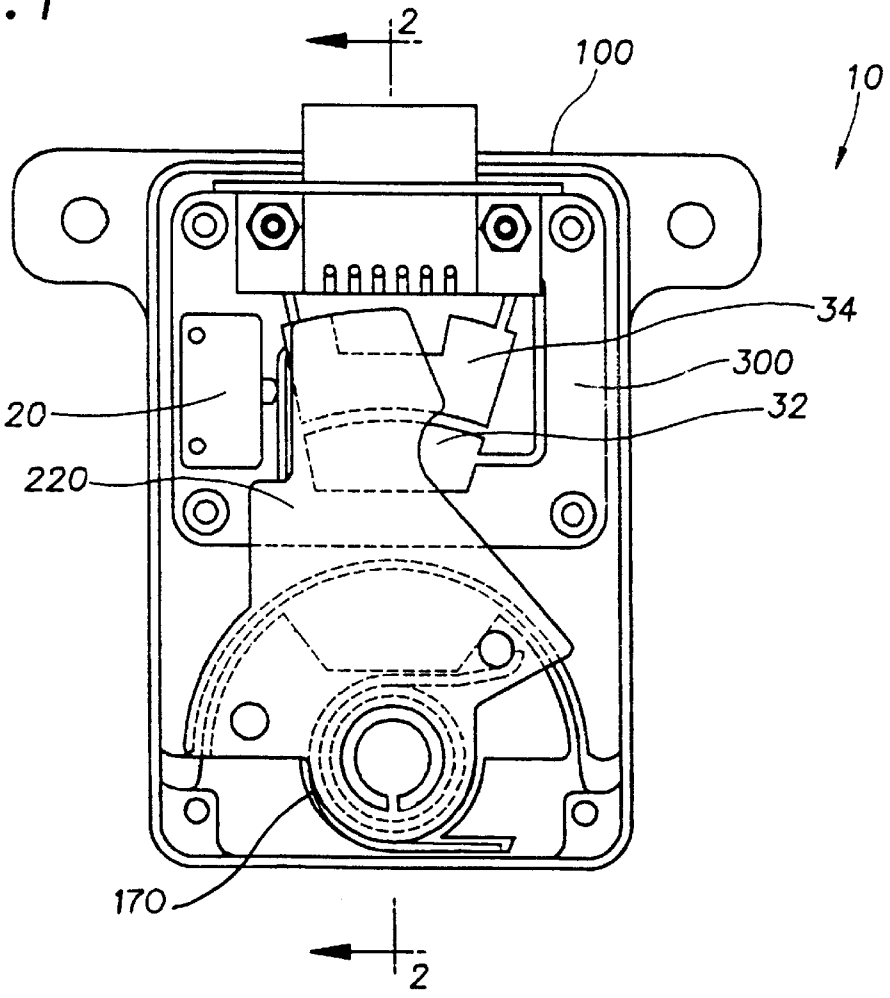
FIG. 1 is a front elevational view of an electrical switch and variable resistance module, with one of the housing sections removed, constructed in accordance with the principles and teachings of the invention as set forth in the aforenoted related patent application and showing the cooperative parts thereof.
Figure 3:
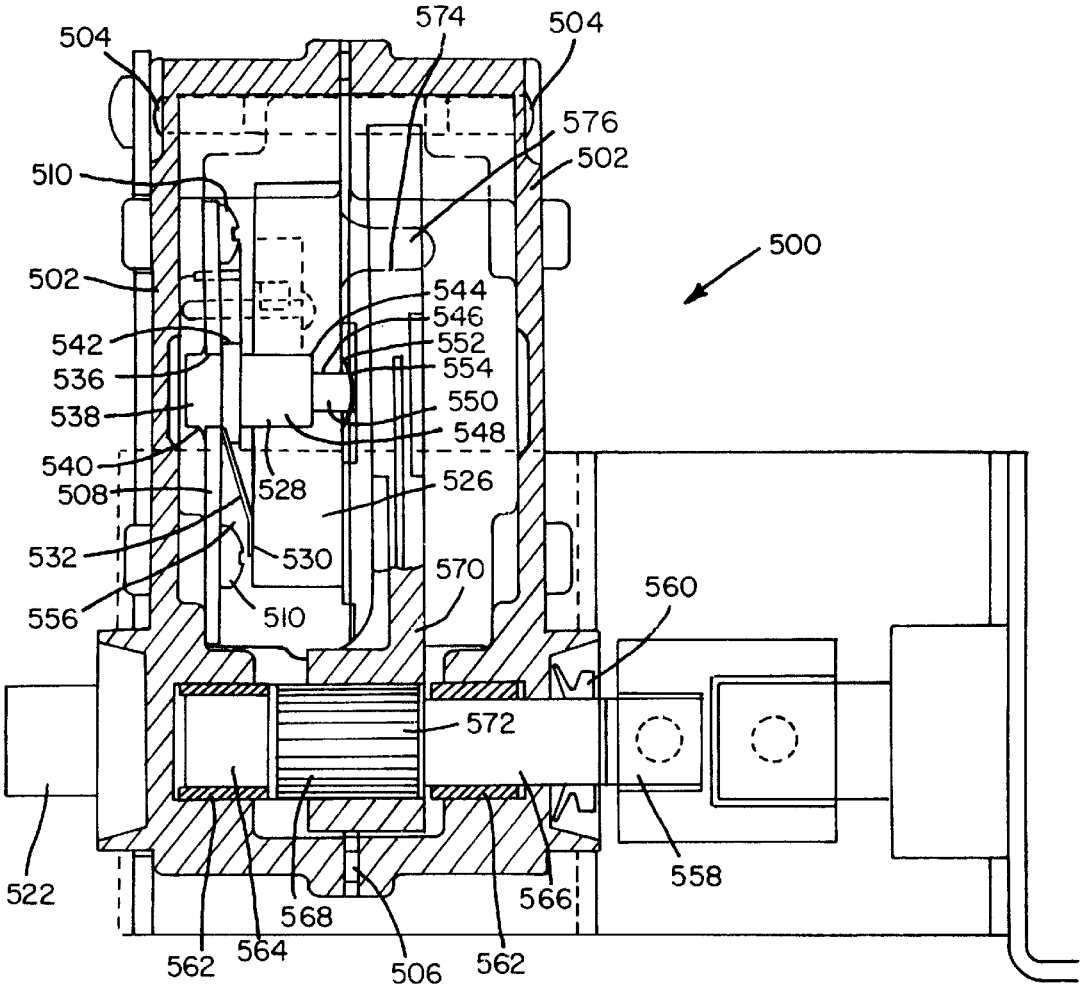
FIG. 3 is a cross-sectional view similar to that of FIG. 2 showing, however, the new and improved accelerator module constructed in accordance with the teachings and principles of the present invention and showing the cooperative parts thereof.
Figure 4:
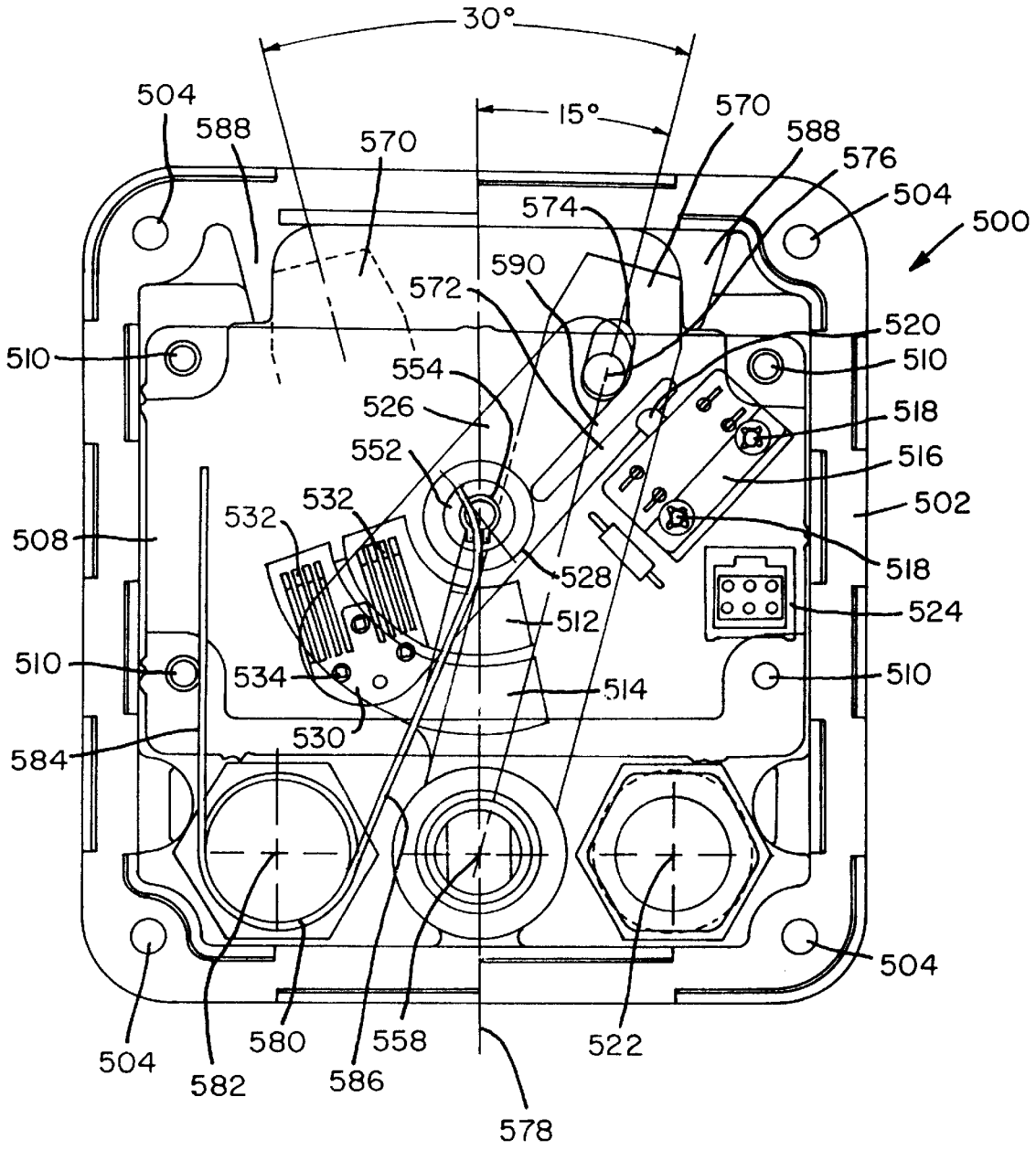
FIG. 4 is a view similar to that of FIG. 1 showing, however, the new and improved accelerator module constructed in accordance with the teachings and principles of the present invention wherein the cooperative parts thereof are shown in their normal non-actuated state.
Figure 5:
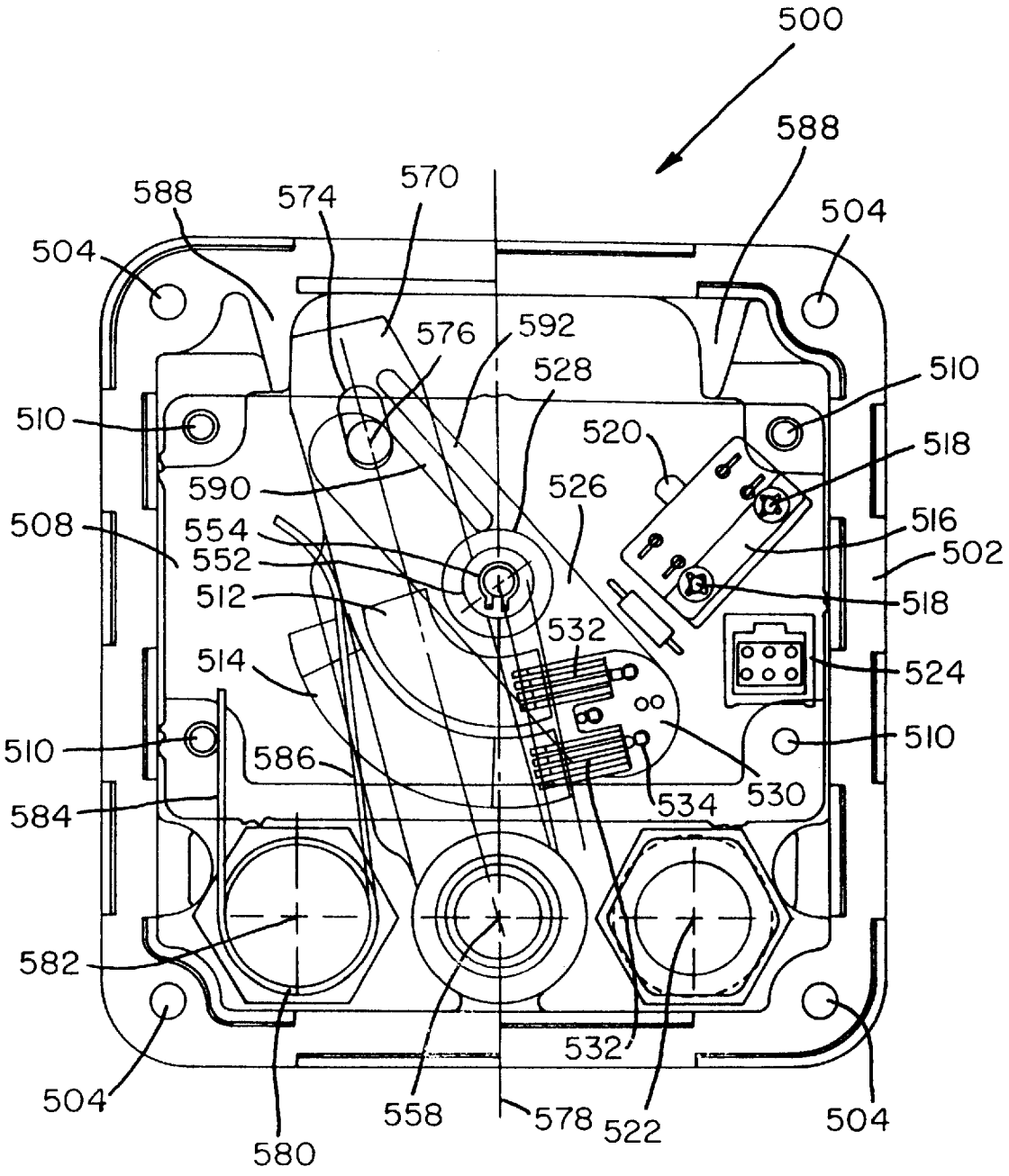
FIG. 5 is a view similar to that of FIG. 4 showing, however, the cooperative parts thereof as disposed in their actuated state.

Referring again to the drawings, and more particularly to FIGS. 3–5 thereof, the new and improved accelerator module constructed in accordance with the principles and teachings of the present invention is illustrated therein and is generally indicated by the reference character 500. The module 500 is seen to comprise a pair of matable housing sections 502 which are securely fastened together by means of a plurality of suitable fasteners, such as, for example, rivets 504, disposed within the four corner regions of the housing sections 502. An annular seal 506 is interposed between the mating surfaces of the housing sections 502 so as to be disposed about the peripheral frame section of the housing as defined by such mating surfaces of the housing sections 502.

A printed circuit board 508 is fixedly mounted upon one of the housing sections 502 by means of a plurality of suitable fasteners, such as, for example, screw fasteners 510, disposed within the four corner regions of the printed circuit board 508, and a constant resistance element 512 and a variable resistance element 514 are formed upon the printed circuit board 508 by techniques which are well-known in the art whereby further discussion of the fabrication of such resistance elements is not necessary and is accordingly not provided. A normally closed switch mechanism 516 is also mounted upon the printed circuit board 508 by means of a plurality of suitable fasteners, such as, for example, screw fasteners 518, and the switch mechanism 516 is electrically associated with the constant resistance element 512 and the variable resistance element 514 as a result of such switch mechanism 516 and the resistance elements 512 and 514 being incorporated within a suitable electrical circuit, not shown. The switch mechanism 516 includes a push-button element 520 which controls the OFF/ON or OPEN/CLOSED states of the switch mechanism 516 when the push-button element 520 is engaged or disengaged in a manner to be described hereinafter. Electrical power is provided to the various electrical components of the module 500 by means of an external electrical connector 522 which projects through one of the housing sections 502 as shown in FIG. 3, as well as being shown in FIGS. 4 and 5, and an internal electrical connector 524 mounted upon the printed circuit board 508.

In accordance with the unique structure and mounting arrangement of the various component parts forming the accelerator module 500 of the present invention, an actuator 526 is pivotably mounted upon the printed circuit board 508 by means of an actuator pivot 528. The actuator 526 carries a wiper member 530 comprising two sets of transversely spaced wiper elements 532 for respectively creating wiping engagement or contact with the constant resistance element 512 and the variable resistance element 514, the wiper member 530 being fixedly secured upon a first end of the actuator 526 by means of suitable fasteners, for example, staking protrusions 534.

As best appreciated from FIG. 3, actuator pivot 528 comprises a substantially cylindrical member having different cylindrical portions or sections thereof which have different diametrical extents or dimensions. More particularly, printed circuit board 508 is provided with an aperture 536 through which a first cylindrical portion or section 538 of the actuator pivot 528 is disposed. An annular pivot ring 540 may be provided, for example, upon a first surface portion of the printed circuit board 508 for fixedly securing or mounting the actuator pivot 528 upon the printed circuit board 508 as a result of clampingly or otherwise engaging the first cylindrical portion or section 538 of the actuator pivot 528 once the actuator pivot 528 is properly axially disposed or seated upon the printed circuit board 508. In order to properly and fixedly seat the actuator pivot 528 upon the printed circuit board 508, when considered from an axial point of view, actuator pivot 528 further comprises an enlarged collar portion or section 542 which is adapted to engage or be seated upon a second opposite surface of the printed circuit board 508. Consequently, actuator pivot 528 is fixedly mounted or seated upon the printed circuit board 508 as a result of the collar portion or section 542 of the actuator pivot 528 being engaged with the second surface of the printed circuit board 508 whereupon the annular pivot ring 540 is then engaged with the first cylindrical portion or section 538 of the actuator pivot 528 as a result of which the printed circuit board 508 is, in effect, clamped between the collar portion or section 542 of the actuator pivot 528 and the annular pivot ring 540.

In order to mount the actuator 526 upon the actuator pivot 528, actuator 526 is provided with a recessed bore 544 and a through-bore 546. Actuator pivot 528 is further provided with a second cylindrical portion or section 548, which is similar to the first cylindrical portion or section 538 and is disposed upon the opposite side of enlarged collar portion or section 542, and a third cylindrical portion or section 550 which has a diametrical extent which is substantially less than those of first and second cylindrical portions or sections 538 and 548. The second cylindrical portion or section 548 of the actuator pivot 528 is adapted to be disposed within the recessed bore 544 of the actuator 526, and the third cylindrical portion or section 550 of the actuator pivot 528 is adapted to project through the through-bore 546 of the actuator 526.

Once the second cylindrical portion or section 548 of the actuator pivot 528 is fully seated within the recessed bore 544 of the actuator 526 and the third cylindrical portion or section 550 of the actuator pivot 528 extends through the through-bore 546 of the actuator 526 so as to project outwardly from the actuator 526, a spring washer 552 is mounted upon the free outwardly projecting end portion of the third cylindrical portion or section 550 of the actuator pivot 528 so as to biasingly engage the actuator 526 whereby the actuator 526 is, in effect, biased with respect to the actuator pivot 528 such that the second cylindrical portion or section 548 of the actuator pivot 528 is constantly axially biased and maintained fully seated within the the recessed portion 544 of the actuator 526. A C-clip type fastener 554 may be additionally secured upon the free end portion of the third cylindrical portion or section 550 of the actuator pivot 528 so as to maintain the spring washer 552 upon the third cylindrical portion or section 550 of the actuator pivot 528.

It may thus be appreciated that by means of the aforenoted structural arrangement, an integral sub-assembly, comprising the printed circuit board 508, the actuator pivot 528, and the actuator 526, has been formed. By controlling the manufacturing tolerances of these limited number of structural components, especially the axial dimensions, for example, of the collar portion 542 and the second cylindrical portion or section 548 of the actuator pivot 528, as well as the axial depth of the recessed portion 544 of the actuator 526, the distance or gap 556 defined between or separating the actuator 526 from the printed circuit board 508, and within which the wiper member 530 is disposed, may be accurately and reliably controlled or defined. Consequently, the wiper member 530 may be biased with a predeterminedly controlled amount of pre-load pressure or biasing force as exerted upon the constant and variable resistance elements 512 and 514 so as not to expose such resistance elements 512 and 514 to excessive wear.

In order to pivotably move the actuator 526, so as to in turn pivotably move the wiper member 530 and the wiper elements 532 thereof with respect to the constant and variable resistance elements 512 and 514 mounted upon the printed circuit board, through an extended arcuate or angular range of movement which is uniquely achieved in accordance with the principles and teachings of the present invention, the actuator 526 comprises a component part of a mechanically advantaged linkage system which is operatively connected to the electric vehicle accelerator pedal, not shown. More particularly, a pivotable input shaft 558, connected at a first end thereof to the accelerator pedal, not shown, has a second end thereof inserted through one of the housing sections 502, as best seen in FIG. 3, and an input shaft seal 560 is disposed about an external portion of the input shaft 558 so as to seal its point of entry into the housing section 502. Suitable axially spaced first and second bearing members 562, 562 are provided within the respective housing sections 502, 502 so as to rotatably or pivotably support corresponding axially spaced first and second portions 564 and 566 of the input shaft 558.

A third portion 568 of the input shaft 558, interposed between the bearing-supported first and second portions 564 and 566 of the input shaft 558, has a first proximal end portion of a radially extending input shaft arm 570 fixedly mounted thereon by any suitable means, such as, for example, splined connections 572. A second distal end portion of the radially extending input shaft arm 570 is provided with an oval-shaped aperture 574, and a pin or projection 576, extending from the surface of actuator 526 which is disposed toward or faces the input shaft arm 570, and extending from an end portion of the actuator 526 which is disposed diametrically opposite the end portion upon which the wiper member 530 is mounted, is disposed and accommodated within the oval-shaped aperture 574 of input shaft arm 570.

As a result of the aforenoted interconnected arrangement defined between the input shaft arm 570 and the actuator 526, comprising more particularly the connection between input shaft arm 570 and actuator 526 as determined by means of the oval-shaped slot or aperture 574 and the projection or pin 576 respectively provided upon the input shaft arm 570 and the actuator 526, as well as the offset locations of the pivotal axes of the input shaft arm 570 and the actuator 526 as determined, respectively by the axes of the input shaft 558 and actuator pivot 528, a mechanically advantaged actuating linkage system is provided for the actuator 526. More particularly, as may best be appreciated from FIGS. 4 and 5, wherein FIG. 4 discloses the various components in their normal state while FIG. 5 discloses the components in their actuated state, it is seen that the input shaft arm 570, in response to pivotable or rotational movement of the input shaft 558, is capable of being pivoted or rotated through an angular or arcuate extent of 15 upon either side of a vertical axis 578 defined between the pivot axes of the input shaft 558 and the actuator pivot 528 such that the input shaft arm 570 is capable of being pivoted or rotated through a complete angular or arcuate extent of 30°. However, as can be seen from the noted drawing figures, actuator 526 undergoes an angular or arcuate movement which is substantially greater than that of the input shaft arm 570 and in fact encompasses an arcuate or angular extent or movement of approximately 83°. This can also be appreciated from the relative dispositions of the wiper member 530, and the wiper elements 532 thereof, with respect to the constant and variable resistance elements 512 and 514 of the printed circuit board 508 when the states of the various components, as illustrated in FIGS. 4 and 5, are compared. By means of this structural arrangement and linkage system, enhanced arcuate or angular sweep movements of the wiper member 530, and the wiper elements 532 thereof, are able to be achieved with smaller or more compact structural components including the actuator 526, the input shaft arm 570, and the printed circuit board 508.

In order to bias or dispose the various components in their various operative states as illustrated in FIGS. 4 AND 5, a torsion spring 580 is coiled about and mounted upon a support shaft 582 such that a first leg 584 of the torsion spring 580 is fixedly engaged with an interior fixed portion or member of one of the housing sections 502 while a second leg 586 of the torsion spring 580 is engaged with a side edge portion of the input shaft arm 570. In this manner, the input shaft arm 570, and the actuator 526 operatively connected to input shaft arm 570 through means of the pin 576 and slot 574 connection, are biased toward their normal state positions as shown in FIG. 4 but the input shaft arm 570, and the actuator 526, are nevertheless permitted to be moved, by means of the splined connection of the input shaft arm 570 with the input shaft 558, from the normal state positions, as shown in FIG. 4, to the actuated positions, as shown in FIG. 5, against the biasing force of torsion spring 580 when rotary input is transmitted to the input shaft arm 570 from input shaft 558. When the rotary input to input shaft arm 570 from input shaft 558 is released or terminated, the biasing force of torsion spring 580 will return the input shaft arm 570, and the actuator 526, back to their normal state positions as shown in FIG. 4.

In order to limit the pivotable movement of the input shaft arm 570 in a predetermined manner between the normal and actuated positions or states shown in FIGS. 4 and 5, the housing sections 502 are provided with internal dependent, laterally spaced stop members 588, 588. In view of the fact that the stop members 588, 588 limit the arcuate or angular extent or travel of the input shaft arm 570, the angular movement or travel extent of the actuator 526 is likewise predeterminedly limited such that the actuator 526 does not cause severe impact forces to be impressed upon the switch mechanism 516, and more particularly, upon the push-button element 520 thereof when the actuator 526 is moved from the actuated state or position shown in FIG. 5 back to the normal state or position shown in FIG. 4 under the biasing influence of the torsion spring 580.

In order to further eliminate, alleviate, or minimize any impact forces which may be impressed upon the switch mechanism 516 and its push-button element 520 by means of the actuator 526, it is noted that the actuator 526 is provided with a longitudinally extending slot 590 which extends from the edge portion of the projection pin 576 end thereof toward the actuator pivot 528 so as to, in effect, define a flexible, cantilevered finger member 592 which actually engages the push-button element 520 of the switch mechanism 516. In this manner, should impact forces be impressed upon the push-button element 520 of the switch mechanism 516 when the actuator 526 is returned to its normal state or position as shown in FIG. 4, the flexibility of the finger portion or member 592 of the actuator will, in effect, absorb or dissipate any impact or shock forces which would normally be transmitted to the switch mechanism 516 and the push-button element 520 thereof, thereby preventing any substantial damage to the switch mechanism 516 and the push-button element 520 thereof.

Thus it may be seen that the accelerator module constructed in accordance with the teachings and principles of the present invention provides noted improvements and advancements in the art. By means of the structural interrelated arrangement of the component parts as more specifically set forth and described hereinbefore, a mechanically advantaged linkage assembly is provided whereby greater arcuate sweep movement of the wiper member, and the wiper elements thereof, is able to be achieved while rendering the various components compact in size. In addition, manufacturing tolerances are able to be readily controlled such that the biasing force or pre-load pressure of the wiper elements upon the printed circuit board does not lead to excessive wear of the resistance elements of the printed circuit board. Lastly, it is noted that the subassembly, comprising the printed circuit board, the actuator pivot, and the actuator mounted upon the printed circuit board by means of the actuator pivot and having the wiper member mounted thereon, is able to be independently used as an integral unit or entity in conjunction with other linkage mechanisms or assemblies.

Obviously, many modifications and variations of the present invention are possible in light of the above teachings. It is therefore to be understood that within the scope of the appended claims, the present invention may be practiced otherwise than as specifically described herein.

What is claimed as new and desired to be protected by Letters Patent of the United States of America is:

1. Apparatus for actuating an electrical switch and providing a variable electrical resistance value indicative of pivotable movement of a pivotably movable member, comprising:

a housing;

an electrical switch disposed within said housing;

an actuator pivotably disposed within said housing;

a movable member pivotably disposed within said housing;

spring means for biasing said actuator toward an initial position at which said actuator engages said electrical switch and for permitting pivotable movement of said actuator away from said electrical switch and against the biasing force of said spring means in response to movement of said actuator by said movable member;

variable electrical resistance means disposed within said housing;

electrically conductive wiper means mounted upon said actuator and disposed in contact with said variable electrical resistance means disposed within said housing for generating a variable electrical resistance, as a result of the movable disposition of said electrically conductive wiper means along said variable electrical resistance means, as a function of said pivotable movement of said actuator away from said electrical switch and against said biasing force of said spring means in response to pivotable movement of said movable member; and linkage means for interconnecting said movable member and said actuator in a mechanically advantaged manner such that when said movable member undergoes a predetermined pivotable movement, said actuator undergoes a correspondingly larger predetermined pivotable movement.

2. The apparatus as set forth in claim 1, wherein:

said movable member comprises a rotary shaft; and said linkage means comprises a linkage arm fixedly mounted at a first end portion thereof upon said rotary shaft and connected at a second end portion thereof to said actuator.

3. The apparatus as set forth in claim 2, wherein:

said actuator is pivotably mounted at a central portion thereof within said housing, said electrically conductive wiper means is mounted upon a first end portion of said actuator, and a second end portion of said actuator is operatively connected to said second end portion of said linkage arm.

4. The apparatus as set forth in claim 3, further comprising:

a printed circuit board mounted within said housing and upon which said variable electrical resistance means is mounted; and said central portion of said actuator is pivotably mounted upon said printed circuit board.

5. The apparatus as set forth in claim 1, wherein:

said predetermined pivotable movement of said movable member comprises an arcuate extent of 30°; and said predetermined pivotable movement of said actuator comprises an arcuate extent of 83°.

6. The apparatus as set forth in claim 2, wherein:

said second end portion of said linkage arm has a substantially oval-shaped aperture defined therein; and said second end portion of said actuator has a pin member projecting outwardly therefrom and disposed within said oval-shaped aperture of said linkage so as to define therewith a mechanical connection between said actuator and said linkage arm.

7. The apparatus as set forth in claim 2, wherein:

said spring means comprises a torsion spring having a first leg thereof fixedly engaged with a portion of said housing, and a second leg thereof engaged with said linkage arm.

8. The apparatus as set forth in claim 4, further comprising:

actuator pivot means for pivotably mounting said actuator upon said printed circuit board.

9. The apparatus as set forth in claim 8, wherein:

said printed circuit board has an aperture defined therethrough;

said actuator has a first recessed bore defined within a first surface portion of said actuator, and a second bore, coaxial with said first recessed bore, defined within a second surface portion of said actuator;

said actuator pivot means comprises a first cylindrical portion extending through said aperture of said printed circuit board, a second cylindrical portion disposed within said first recessed bore of said actuator, a third cylindrical portion extending through said second bore of said actuator, and a collar portion, interposed between said first and second cylindrical portions of said actuator for engaging a first surface portion of said printed circuit board;

first fastening means interconnecting said first cylindrical portion of said actuator pivot and a second surface portion of said printed circuit board such that said printed circuit board is clamped between said first fastening means and said collar portion of said actuator pivot means; and second fastening means interconnecting said third cylindrical portion of said actuator pivot means and said second surface portion of said actuator.

10. The apparatus as set forth in claim 3, wherein:

said second end portion of said actuator has a slot defined therein such that a flexible, cantilevered finger is formed upon said second end portion of said actuator for flexibly engaging said electrical switch when said actuator is disposed at said initial position.

11. An accelerator module for actuating an electrical switch and providing a variable electrical resistance value which is indicative of movement of an accelerator pedal upon an electric vehicle, comprising:

a housing;

an electrical switch disposed within said housing;

an actuator pivotably disposed within said housing;

shaft means pivotably disposed within said housing for connection to said accelerator pedal of said electric vehicle;

spring means for biasing said actuator toward an initial position at which said actuator engages said electrical switch and for permitting pivotable movement of said actuator away from said electrical switch and against the biasing force of said spring means in response to movement of said actuator by said shaft means and said accelerator pedal of said electric vehicle;

variable electrical resistance means disposed within said housing;

electrically conductive wiper means mounted upon said actuator and disposed in contact with said variable electrical resistance means disposed within said housing for generating a variable electrical resistance, as a result of the movable disposition of said electrically conductive wiper means along said variable electrical resistance means, as a function of said pivotable movement of said actuator away from said electrical switch and against said biasing force of said spring means in response to pivotable movement of said shaft means; and linkage means for interconnecting said shaft means and said actuator in a mechanically advantaged manner such that when said shaft means undergoes a predetermined pivotable movement, said actuator undergoes a correspondingly larger predetermined pivotable movement.

12. The accelerator module as set forth in claim 11, wherein:

a printed circuit board is mounted within said housing and has said variable electrical resistance means mounted thereon;

said linkage means comprises a linkage arm fixedly mounted at a first end portion thereof upon said shaft means and connected at a second end portion thereof to said actuator; and said actuator is pivotably mounted at a central portion thereof upon said printed circuit board, said electrically conductive wiper means is mounted upon a first end portion of said actuator, and a second end portion of said actuator is operatively connected to said second end portion of said linkage arm.

13. The accelerator module as set forth in claim 11, wherein:

said predetermined pivotable movement of said shaft means comprises an arcuate extent of 30°; and said predetermined pivotable movement of said actuator comprises an arcuate extent of 83°.

14. The accelerator module as set forth in claim 12, wherein:

said second end portion of said linkage arm has a substantially oval-shaped aperture defined therein; and said second end portion of said actuator has a pin member projecting outwardly therefrom and disposed within said oval-shaped aperture of said linkage arm so as to define therewith a mechanical connection between said actuator and said linkage arm.

15. The accelerator module as set forth in claim 12, wherein:

said spring means comprises a torsion spring having a first leg thereof fixedly engaged with a portion of said housing, and a second leg thereof engaged with said linkage arm.

16. The accelerator module as set forth in claim 12, further comprising:

actuator pivot means for pivotably mounting said actuator upon said printed circuit board.

17. The accelerator module as set forth in claim 16, wherein:

said printed circuit board has an aperture defined therethrough;

said actuator has a first recessed bore defined within a first surface portion of said actuator, and a second bore, coaxial with said first recessed bore, defined within a second surface portion of said actuator;

said actuator pivot means comprises a first cylindrical portion extending through said aperture of said printed circuit board, a second cylindrical portion disposed within said first recessed bore of said actuator, a third cylindrical portion extending through said second bore of said actuator, and a collar portion, interposed between said first and second cylindrical portions of said actuator for engaging a first surface portion of said printed circuit board;

first fastening means interconnecting said first cylindrical portion of said actuator pivot and a second surface portion of said printed circuit board such that said printed circuit board is clamped between said first fastening means and said collar portion of said actuator pivot means; and second fastening means interconnecting said third cylindrical portion of said actuator pivot means and said second surface portion of said actuator.

18. The accelerator module as set forth in claim 12, wherein:

said second end portion of said actuator has a slot defined therein such that a flexible, cantilevered finger is formed upon said second end portion of said actuator for flexibly engaging said electrical switch when said actuator is disposed at said initial position.

19. a variable electrical resistance assembly for generating a variable electrical resistance value which is indicative of pivotable movement of a pivotably movable member, comprising:

a printed circuit board;

variable electrical resistance means disposed upon said printed circuit board;

actuator pivot means for pivotably mounting an elongate actuator, at a substantially central portion thereof, upon said printed circuit board;

said elongate actuator having means disposed upon a first end thereof, at a position which is radially remote from said substantially central actuator pivot means, for connecting said elongate actuator to a pivotably movable member; and electrically conductive wiper means mounted upon a second end of said elongate actuator, at a position which is radially remote from said substantially central actuator pivot means and disposed substantially diametrically opposite said first end of said elongate actuator, and disposed in contact with said variable electrical resistance means disposed upon said printed circuit board, for generating a variable electrical resistance value, as a result of the movable disposition of said electrically conductive wiper means along said variable electrical resistance means, as a function of the pivotable movement of said actuator in response to the pivotable movement of the pivotably movable member.

20. The assembly as set forth in claim 19, wherein:

said actuator is pivotably mounted at a central portion thereof upon said printed circuit board, said electrically conductive wiper means is mounted upon a first end portion of said actuator, and said means for connecting said actuator to said pivotably movable member is mounted upon a second end portion of said actuator.

21. The assembly as set forth in claim 19, wherein:

said printed circuit board has an aperture defined therethrough;

said actuator has a first recessed bore defined within a first surface portion of said actuator, and a second bore, coaxial with said first recessed bore, defined within a second surface portion of said actuator;

said electrically conductive wiper means is mounted upon said first surface portion of said actuator;

said actuator pivot means comprises a first cylindrical portion extending through said aperture of said printed circuit board, a second cylindrical portion disposed within said first recessed bore of said actuator, a third cylindrical portion extending through said second bore of said actuator, and a collar portion, interposed between said first and second cylindrical portions of said actuator for engaging a first surface portion of said printed circuit board, said first surface portion of said printed circuit board being spaced a predetermined distance from said first surface portion of said actuator so as to define a predetermined gap between said first surface portion of said printed circuit board and said first surface portion of said actuator within which said electrically conductive wiper means is disposed such that said electrically conductive wiper means engages said variable electrical resistance means of said printed circuit board with a predeterminedly biased wiping force;

first fastening means interconnecting said first cylindrical portion of said actuator pivot and a second surface portion of said printed circuit board such that said printed circuit board is clamped between said first fastening means and said collar portion of said actuator pivot means; and second fastening means interconnecting said third cylindrical portion of said actuator pivot means and said second surface portion of said actuator.

* * * * *